United States Patent [19]

Caddock, Jr.

[11] 4,132,971

[45] Jan. 2, 1979

[54] NONINDUCTIVE FILM-TYPE CYLINDRICAL RESISTOR AND METHOD OF MAKING IT

[76] Inventor: Richard E. Caddock, Jr., 5623 Bedford, Riverside, Calif. 92507

[21] Appl. No.: 772,654

[22] Filed: Feb. 28, 1977

[51] Int. Cl.[2] ..... H01C 3/02

[52] U.S. Cl. ..... 338/61; 29/612; 29/620; 338/195; 338/292; 338/294; 338/308; 427/102

[58] Field of Search ..... 338/61, 62, 63, 195, 338/292, 294, 306–309, 287; 29/610, 612, 620; 427/101, 102

[56] References Cited

U.S. PATENT DOCUMENTS

| | | | |
|---|---|---|---|
| 3,594,679 | 7/1971 | Seay | 29/620 X |
| 3,880,609 | 4/1975 | Caddock | 29/620 |

FOREIGN PATENT DOCUMENTS

| | | | |
|---|---|---|---|
| 1314388 | 4/1973 | United Kingdom | 338/195 |

*Primary Examiner*—C. L. Albritton

*Attorney, Agent, or Firm*—Richard L. Gausewitz

[57] ABSTRACT

A highly stable noninductive film-type cylindrical resistor which can be economically mass-produced, with few rejects, even when the film is one having a very high resistance. This is accomplished by providing, in a silk-screened serpentine film pattern, parallel rows of bend or base regions which are on opposite sides of a longitudinal gap, and which are very wide in comparison to the remainder of the pattern. The exterior of the film is then lapped, until the resistance increases to a desired value, by effecting relative rotation between the resistor and a flexible lapping tape having a desired tension. For high-value resistors, the resistive film is caused to have a value (in ohms per square) higher than would be practical if the lapped bends were not relatively wide.

7 Claims, 3 Drawing Figures

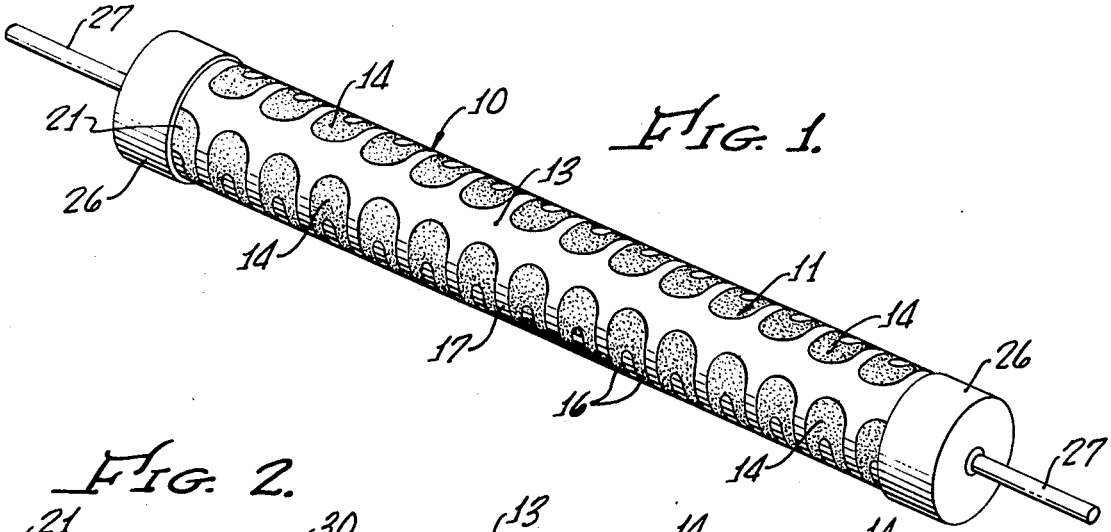
FIG. 1.
FIG. 2.
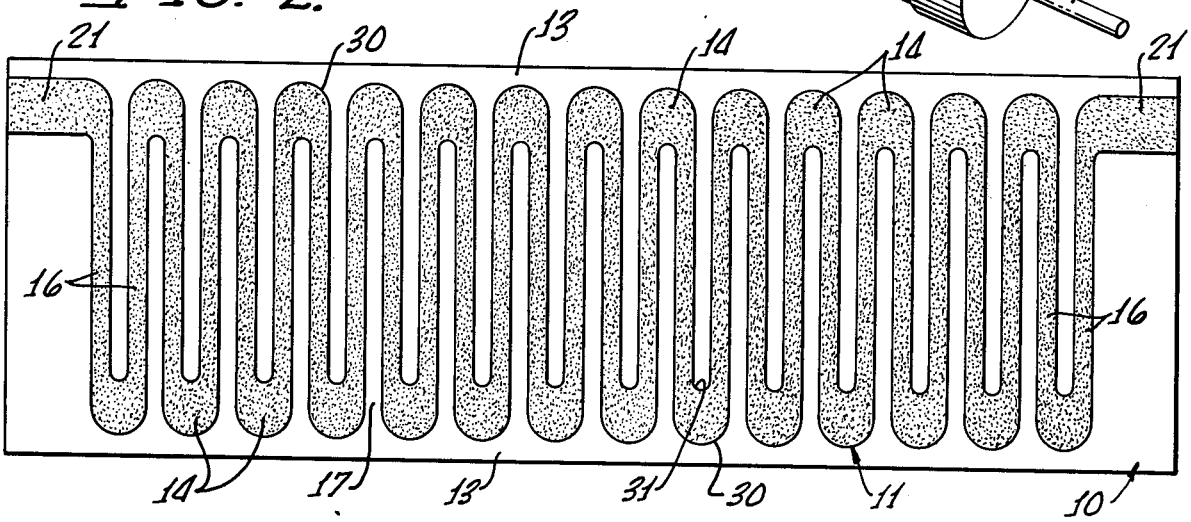
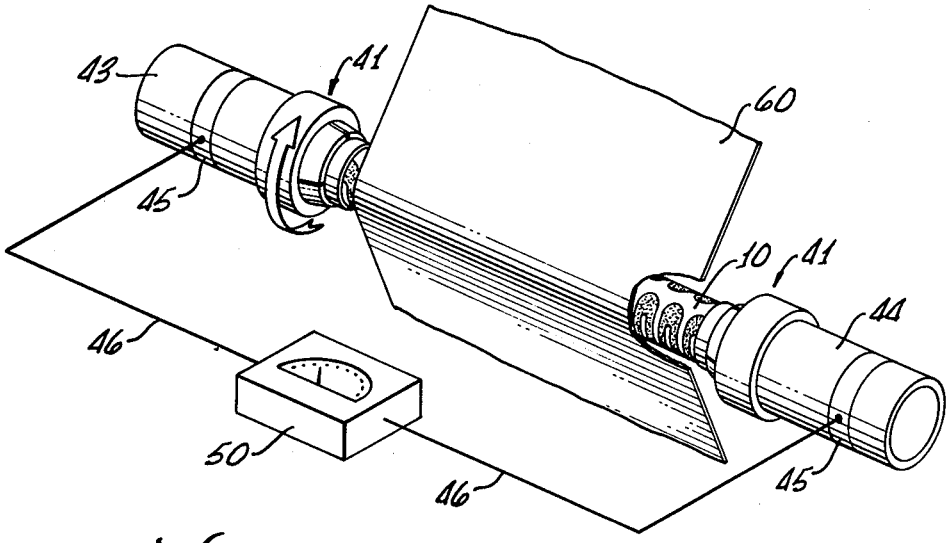
FIG. 3.

NONINDUCTIVE FILM-TYPE CYLINDRICAL RESISTOR AND METHOD OF MAKING IT

BACKGROUND OF THE INVENTION

1. Field of the Invention

This invention relates to the field of cylindrical film-type resistors.

2. Description of Prior Art

The present invention constitutes an improvement over what is shown and described in U.S. Pat. No. 3,858,147, inventor Richard E. Caddock. Such patent is hereby incorporated by reference herein, as though set forth in full.

The cited patent shows and describes a silk-screened serpentine resistive film pattern which is uniform in width. Stated otherwise, the serpentine "line" of resistive material is shown as having a constant width throughout the full length of the line, the bend regions of the line being no wider than are the parallel arm regions thereof. The cited patent also specifically discloses two ways of trimming the resistive film in order to achieve the desired ohmic value. One such way is to abrade a predetermined small region of the film, and a second such way is to partially grind the entire film exterior.

The first-mentioned method of trimming is relatively uneconomic and/or disadvantageous. For example, when the predetermined small abraded region extends circumferentially of the cylindrical substrate—which is believed to be usually the only practical thing to do relative to the present serpentine film pattern—there may be created a circumferentially-extending weak spot (stress-riser line) in the substrate. Such circumferential stress riser increases the chances that the substrate will break in two when stressed.

The second-mentioned method of trimming, namely grinding (or lapping) the entire exterior of the film, also produces disadvantages particularly relative to film materials having very high resistances. It is pointed out that when a film-forming resistive material has a high inherent resistance, there will be relatively few conductive paths (microscopic in size) through any predetermined small region thereof. Conversely, a film-forming material having a low inherent resistance will be characterized by the presence of many conductive paths through any such predetermined region. Thus, when a high-resistance film is partially abraded or lapped away, to reduce its thickness and thereby increase its resistance, there is a distinct chance of creating a discontinuity or interruption in the line of film since all or substantially all of the microscopic flow paths may be broken.

It is strongly emphasized that the discontinuity or interruption described in the preceding paragraph may not manifest itself immediately, but instead only after passage of time and changes in environment have occurred. Thus, in the absence of the present invention, instabilities may develop in the field.

Relative to prior art other than the cited Caddock patent, it is known to provide serpentine resistive films in which the bend regions are relatively wide in comparison to the remaining regions. However, there is no prior art known to applicant wherein a wide-bend pattern is employed in conjunction with a longitudinal gap in the film, or with lapping (or grinding) of the entire exterior of the film. For these and other reasons, the present article and method are not disclosed or suggested by the prior art.

SUMMARY OF THE INVENTION

A silk-screened noninductive serpentine film pattern on a cylindrical substrate, and having parallel rows of bend regions on opposite sides of a longitudinal gap in the film, is trimmed to a surprisingly high degree and with no substantial danger of creating a discontinuity. This is because the bend regions are caused to be wider than are the parallel arm regions. The trimming is effected by means of a flexible lapping tape which is bent partially around the cylindrical resistor and rotated relative thereto. The present method therefore comprises effecting such lapping of such a pattern until the desired resistance value is achieved. The present article comprises such a resistor which has been thus trimmed.

BRIEF DESCRIPTION OF THE drawings

FIG. 1 is an isometric view showing a resistor embodying the present invention, but prior to the application of any environmentally protective coating;

FIG. 2 is a developed view, illustrating the exterior surface of the resistor of FIG. 1 as if such surface were planar instead of cylindrical; and FIG. 3 is an isometric view showing the method step whereby the cylindrical resistor is lapped by flexible lapping tape.

DETAILED DESCRIPTION OF THE PREFERRED EMBODIMENT

Referring to FIG. 1, the resistor comprises an elongated cylinder 10 (the substrate) formed of electrically insulating material, preferably a suitable heat-resistant ceramic such as aluminum oxide. Provided exteriorly on cylinder 10, in adherent relationship relative to the cylindrical surface, is a resistive film 11. The film comprises an elongated strip 12 which is shaped in a noninductive serpentine pattern as illustrated.

Although the resistive film extends around at least a majority of the circumference of the cylinder 10, and is present at major areas of the surface of such cylinder, it is not present along a longitudinal gap 13 which extends for the full length of cylinder 10 parallel to the axis thereof. The gap 13 is sufficiently wide that there will not be any voltage breakdown between portions of film 11 on opposite sides of the gap, and is also sufficiently wide that the squeegee of a silk-screening apparatus may be disposed at the gap without resulting in any overprinting of the resistive film pattern. Gap 13 is at least about 0.015 inch wide.

The film pattern comprises a multiplicity of series-related hairpin-shaped portions each having a U-shaped bend or base (turn) 14 and also having parallel arms 16. Adjacent arms 16 pass current in opposite directions, the result being that the generated magnetic fields efficiently neutralize each other to prevent the creation of substantial inductance in the resistor.

The illustrated U-shaped bend or base portions 14 of the resistive film are disposed in two parallel rows, one row on each side of the gap 13, each row extending substantially axially of the cylindrical substrate. The arms 16 thus extend circumferentially of the cylindrical surface, whereas at least portions of the bases (bends) extend longitudinally thereof.

The width of each arm 16 is relatively small. The range may be between about 8 thousandths of an inch and about 100 thousandths of an inch. It is possible to have widths of arms 16 less than 8 thousandths, but this may interfere with production speed and repeatability.

Preferably, the width of each arm 16 is substantially the same as the width of each space between adjacent arms, except that the width of each space between adjacent arms is preferably about 50 thousandths of an inch or less for highly effective inductance cancellation. Such spaces are illustrated at 17 in FIGS. 1 and 2.

The thickness of strip 12 (that is to say, of each arm 16 and each bend or base 14), and which is to be distinguished from the width thereof, is preferably in the range of between about 0.2 thousandths of an inch at its maximum dimension and about 2 thousandths of an inch at its maximum dimension. Such thicknesses are those present immediately after silk-screening, prior to any lapping. The range is specified relative to "maximum dimensions" because (as shown in FIG. 4 of U.S. Pat. No. 3,858,147) the exterior surfaces of the edge portions of the strip taper (converge) toward the cylindrical surface of the substrate, so that there is no sharp corner or dropoff point.

The present pattern need not incorporate the wide portion shown at 18 in the U.S. Pat. No. 3,858,147, since the trimming operation is always performed by lapping as described below. Except for this omission, and except for the highly important wide bend regions and their lapping as next to be described, the present resistor is identical to the one shown and described in the cited U.S. Pat. No. 3,858,147.

In accordance with the present invention, the bend or base regions 14 are caused to be much wider than are the various arms 16. It is to be noted that the width of each arm 16 is measured in the direction longitudinal of the resistor, whereas the width of each bend or base 14 is measured in the direction circumferential to the resistor.

The width of each bend or base 14 is preferably at least two times that of each arm, and (especially when the arms are relatively narrow) is preferably at least three times the width of each arm. Thus, for example, if the width each arm 16 (the dimension longitudinal to the cylindrical substrate) is 10 thousandths of an inch, the width of each bend or base 14 (measured circumferentially of the cylindrical substrate) is caused to be 30 thousandths of an inch.

As above noted, all bends 14 lie on only one semicylindrical portion of the cylindrical substrate (in that the film is present on the majority of the circumference of the substrate). Also as stated, the adjacent regions of the bends are separated circumferentially from each other by the above-described gap 13. Each bend is preferably defined by an arcuate edge region, as shown at 30 and 31 in FIG. 2.

At opposite ends of the serpentine strip 12 of resistive film are terminal portions 21 which preferably extend parallel to the axis of cylinder 10 and adjacent (but not in) gap 13. Both terminal portions 21 are preferably on a single side of the gap 13. In accordance with the present invention, the terminal portions 21 are much wider than are the arm portions 16 of the serpentine strip. Desirably, the terminal portions have the same widths (circumferential dimensions) as do the bend or base regions 14 of the resistive film strip.

The terminal portions 21 are associated with highly conductive cylindrical films (not shown in the present drawing, but shown at 23 and 24 in FIGS. 3, 5 and 8 of U.S. Pat. No. 3,858,147).

Metal end caps or cups 26 are press-fit over the ends of cylinder 10, that is to say over the cylindrical highly conductive films at such ends, and over large portions of the terminal portions 21. Electrical contact is thus formed, effectively, with the conductive films and thus with terminal portions 21. Axial leads 27 extend outwardly from the end caps 26, being electrically and physically connected to such end caps by suitable means.

In accordance with the present method, the resistive films are silk-screened onto substrate 10, but with the major exceptions that the bends or base portions 14 are relatively wide as stated. The silk-screened coatings are heated (cured) as described in the U.S. Pat. No. 3,858,147. Then, the end caps 26 are press-fit over the ends of the cylinder 10, and the resulting assembly is placed in chucks 41 (FIG. 3) on rotating axially-aligned electrically conductive shafts 43 and 44. The shafts 43 and 44 are driven synchronously with each other by suitable motor means, not shown. Slip rings 45, and leads 46, are employed to connect the end caps 26 to an ohmmeter 50.

A lapping tape 60, formed of flexible material and having a finely divided abrasive substance adherently applied to one surface thereof, is then bent around the resistor as shown in FIG. 3. The bending is preferably such that the two regions of the tape 60 on the opposite sides of the resistor are at an obtuse angle to each other. Preferably, the lapping tape extends for almost the full distance between the inner edges of end caps 26. The tape is under a predetermined relatively low tension adapted to cause abrading away of substantially the entire exterior of the resistive film as the substrate is rotated.

Relative rotation is then effected between the tape and the resistor, preferably by causing rotation of the resistor about the common axis of the resistor, the chucks 41, and shafts 43–44. As rotation continues, the resistance indicated by ohmmeter 50 progressively increases due to the reduction in thickness of the resistive film.

When the ohmmeter 50 reads the desired value, rotation is stopped and the tape 60 removed. Thereafter, it is merely necessary to apply one or more environmentally protective coatings as described relative to FIG. 3 in U.S. Pat. No. 3,858,147.

Because of the precision of the silk-screening method, most of the resistance values of various resistors in a given run are initially within plus or minus a small percent of the desired final resistance value. However, in a number of cases the resistance can vary by as much as 30 percent. It has been found that, particularly with the resistive films having relatively high inherence resistance values (ohms per square), adequate increase of the resistance of resistors this far out of tolerance may create substantial interruptions or discontinuities as discussed in the early portions of this specification. However, with the present relatively wide base regions or bends 14, such interruptions or discontinuities very seldom result even though relatively large amounts of resistive film are lapped off of the film. Thus, discontinuities and/or instabilities do not occur, in the factory or in the field, as often as formerly.

With the present method, and which produces the described resistor having wide bends and an exterior surface lapped by means of lapping tape as described, it is practical to cause the coating (resistive film) to have a very high value in ohms. Thus, the resistance of the overall resistor may be extremely high. Since the practicality and commercial acceptance of a given resistor may depend upon the amount of resistance value it is possible to place upon a given surface area, this consideration is often very important. It is emphasized, however, that even with lower value resistors (resistors incorporating film having lower inherent value) the present method and article are important in that various resistors which would otherwise have to be scrapped may be lapped up to the desired resistance values and thus saved.

The foregoing detailed description is to be clearly understood as given by way of illustration and example only, the spirit and scope of this invention being limited solely by the appended claims.

I claim:

1. A stable, cylindrical film-type resistor, which comprises:
(a) an elongated cylindrical substrate, and
(b) an electrically resistive film silk-screened onto the exterior cylindrical surface of said substrate,
said film comprising an elongated serpentine strip of resistive material,
said film being absent from a substantial gap which extends along the full length of one side of said surface parallel to the axis of said substrate,
said strip comprising a multiplicity of hairpin-shaped portions the arms of which are substantially parallel to each other and extend circumferentially around at least half of said surface,
said hairpin-shaped portions having bends or bases which connect said arms and which are much wider than are the widths of said arms,
the widths of said bends or bases being measured circumferentially of said substrate, said widths of said arms being measured longitudinally of said substrate,
the widths of said bends or bases being at least twice that of said arms,
said film having been trimmed by effecting relative rotation between the resistor and a lapping means placed in abrading contact with the resistor and then relatively rotated about the axis of the resistor,
whereby the exterior surface of said film is lapped.

2. The invention as claimed in claim 1, in which the width of said bends is at least three times that of said arms.

3. A stable, cylindrical film-type resistor, which comprises:
(a) an elongated cylindrical substrate, and
(b) an electrically resistive film silk-screened onto the exterior cylindrical surface of said substrate,
said film comprising an elongated serpentine strip of resistive material,
said film being absent from a substantial gap which extends along the full length of one side of said surface parallel to the axis of said substrate,
said gap having a width, circumferentially of said substrate, of at least 0.015 inch,
said strip comprising a multiplicity of hairpin-shaped portions the arms of which are substantially parallel to each other and extend circumferentially around at least half of said surface,
said hairpin-shaped portions having bends or bases which connect said arms and which are much wider than are the widths of said arms,
the widths of said bend or bases being measured circumferentially of said substrate, said widths of said arms being measured longitudinally of said substrate,
said film having been trimmed by effecting relative rotation between the resistor and a lapping means placed in abrading contact with the resistor and then relatively rotated about the axis of the resistor,
whereby the exterior surface of said film is lapped.

4. A method of manufacturing a highly stable cylindrical film-type resistor, which comprises:
(a) providing an elongated cylindrical substrate,
(b) silk-screening onto the exterior cylindrical surface of said substrate an electrically resistive film comprising an elongated serpentine strip of resistive material, said film being absent from a substantial gap which extends along the full length of one side of said surface parallel to the axis of said substrate, said strip comprising a multiplicity of generally hairpin-shaped portions the arms of which extend generally circumferentially around at least half of said surface, and the bends or bases of which are much wider than are the widths of said arms,
the widths of said bends or bases being measured circumferentially of said substrate, said widths of said arms being measured longitudinally of said substrate,
said bends or bases having widths at least two times the widths of said arms, and
(c) trimming said resistor by effecting relative rotation, about the axis of the resistor, between the resistor and a lapping means which is placed in abrading contact with the resistor, said trimming being continued until the resistance of said strip rises to a pedetermined value.

5. The invention as claimed in claim 4, in which said method further comprises causing said bends to have widths at least three times the widths of said arms.

6. A method of manufacturing a highly stable cylindrical film-type resistor, which comprises:
(a) providing an elongated cylindrical substrate,
(b) silk-screening onto the exterior cylindrical surface of said substrate an electrically resistive film comprising an elongated serpentine strip of resistive material, said film being absent from a substantial gap which extends along the full length of one side of said surface parallel to the axis of said substrate, said strip comprising a multiplicity of generally hairpin-shaped portions the arms of which extend generally circumferentially around at least half of said surface, and the bends or bases of which are much wider than are the widths of said arms,
the widths of said bends or bases, and of said gap, being measured circumferentially of said substrate, the widths of said arms being measured longitudinally of said substrate,
said gap having a width of at least 0.015 inch, and
(c) trimming said resistor by effecting relative rotation, about the axis of the resistor, between the resistor and a lapping means which is placed in abrading contact with the resistor, said trimming being continued until the resistance of said strip rises to a predetermined value.

7. A method of manufacturing a highly stable cylindrical film-type resistor, which comprises:
(a) providing an elongated cylindrical substrate,
(b) silk-screening onto the exterior cylindrical surface of said substrate an electrically resistive film comprising an elongated serpentine strip of resistive material, said film being absent from a substantial gap which extends along the full length of one side of said surface parallel to the axis of said substrate, said strip comprising a multiplicity of generally hairpin-shaped portions the arms of which extend generally circumferentially around at least half of said surface, and the bends or bases of which are much wider than are the widths of said arms, the widths of said bends or bases being measured circumferentially of said substrate, said widths of said arms being measured longitudinally of said substrate, and (c) trimming said resistor by effecting relative rotation, about the axis of the resistor, between the resistor and a lapping means which is placed in abrading contact with the resistor, said trimming being continued until the resistance of said strip rises to a predetermined value, said lapping means being a flexible tape which bends around at least one side of the resistor.

* * * * *